US011618612B2

(12) United States Patent
Stratton

(10) Patent No.: US 11,618,612 B2
(45) Date of Patent: Apr. 4, 2023

(54) VENTED POUR SPOUT

(71) Applicant: Container Packaging Systems, LLC, Churubusco, IN (US)

(72) Inventor: Jon Stratton, Churubusco, IN (US)

(73) Assignee: CONTAINER PACKAGING SYSTEMS, LLC, Churubusco, IN (US)

( * ) Notice: Subject to any disclaimer, the term of this patent is extended or adjusted under 35 U.S.C. 154(b) by 146 days.

(21) Appl. No.: 16/803,736

(22) Filed: Feb. 27, 2020

(65) Prior Publication Data

US 2020/0270026 A1 Aug. 27, 2020

Related U.S. Application Data

(60) Provisional application No. 62/805,756, filed on Feb. 27, 2019.

(51) Int. Cl.
*B67D 3/00* (2006.01)
*B65D 25/48* (2006.01)

(52) U.S. Cl.
CPC ..... *B65D 25/48* (2013.01); *B65D 2205/00* (2013.01)

(58) Field of Classification Search
CPC ..... B65D 25/48; B65D 2205/00; B65D 47/32
See application file for complete search history.

(56) References Cited

U.S. PATENT DOCUMENTS 1,362,186 A * 12/1920 Price ..... B65D 25/40 222/462
1,428,297 A * 9/1922 Price ..... B65D 47/06 222/478
1,855,373 A * 4/1932 Willumsen ..... B65D 25/40 222/484
3,399,811 A * 9/1968 Miller ..... B65D 49/04 222/147
4,928,861 A * 5/1990 Schiemann ..... B65D 1/20 222/189.07
5,628,352 A 5/1997 Gracyalny
6,378,742 B1 4/2002 Rohr
(Continued)

FOREIGN PATENT DOCUMENTS

CA 2309568 A1 11/2000
CH 716152 A1 * 11/2020 ..... B67C 9/00
(Continued)

OTHER PUBLICATIONS

53vml (30mv) Ball Float Vent Valves, http://www.opwglobal.com/products/us/retail-fueling-products/below-ground-products/underground-storage-tank-equipment/overfill-prevention-valves/53vml-30mv-ball-float-vent-valves; Jun. 28, 2018.

*Primary Examiner* — Bob Zadeh
(74) *Attorney, Agent, or Firm* — Lempia Summerfield Katz LLC

(57) ABSTRACT

A pour spout has a spout section with an elongate tubular body defining a liquid flow channel. The body has a fluted or corrugated configuration rendering the body flexible or bendable. A dispensing orifice is disposed at a dispensing end of the pour spout and an attachment end is disposed at an end of the body opposite the dispensing end. The attachment end has a liquid inlet orifice. A vent section of the pour spot is joined to the attachment end of the body. The vent section includes an air vent that defines an air flow path, which directs air from outside of the pour spout along the air flow path toward a container interior while bypassing the liquid flow channel.

11 Claims, 7 Drawing Sheets

(56) References Cited

U.S. PATENT DOCUMENTS

| | | | | |
|---|---|---|---|---|
| 2004/0250879 | A1* | 12/2004 | Chrisco | B67D 7/005 141/286 |
| 2005/0056652 | A1 | 3/2005 | Cezeaux | |
| 2005/0098589 | A1 | 5/2005 | Felten | |
| 2005/0184026 | A1 | 8/2005 | Haley | |
| 2008/0067194 | A1 | 3/2008 | Faurie | |
| 2008/0314858 | A1 | 12/2008 | Twohig | |
| 2011/0144598 | A1 | 6/2011 | Mihashi | |
| 2012/0228338 | A1* | 9/2012 | Magley, II | B67D 7/005 222/481.5 |
| 2013/0056502 | A1 | 3/2013 | Zapp | |
| 2013/0299522 | A1* | 11/2013 | Magley, II | B23P 19/00 222/481.5 |
| 2014/0332568 | A1* | 11/2014 | Stratton | B67D 7/005 222/481.5 |
| 2016/0060005 | A1* | 3/2016 | Dodia | B65D 47/06 222/478 |
| 2016/0101911 | A1 | 4/2016 | Stratton | |
| 2018/0346212 | A1* | 12/2018 | Latimer | B65D 47/32 |
| 2019/0112111 | A1* | 4/2019 | Smith | B65D 25/48 |
| 2020/0270026 | A1* | 8/2020 | Stratton | B65D 47/32 |

FOREIGN PATENT DOCUMENTS

| | | | | | |
|---|---|---|---|---|---|
| CN | 202508430 | U | | 10/2012 | |
| GB | 2460688 | A | * | 12/2009 | A47K 5/122 |
| GB | 2508735 | A | | 6/2014 | |
| WO | 9513220 | A1 | | 5/1995 | |

* cited by examiner

VENTED POUR SPOUT

RELATED APPLICATION DATA

This patent is entitled to the benefit of and claims priority to U.S. Provisional Application Ser. No. 62/805,756 filed Feb. 27, 2019 and entitled "Vented Pour Spout." The entire contents of this prior filed application are hereby incorporated herein by reference.

BACKGROUND

1. Field of the Disclosure

The present disclosure is generally directed to pour spouts for liquid containers, and more particularly to a vented spout that allows pouring liquid from such a container while allowing air back into the container to replace the lost liquid.

2. Description of Related Art

Pour spouts that vent, i.e., venting spouts, and containers with vents, i.e., vented containers are known in the art. A typical refillable liquid container of the type that stores liquid and dispenses the liquid from a pour spout has a vent feature or venting capability of some type. The vent is provided to allow air to enter the container as liquid is dispensed to replace the lost liquid and equalize pressure in the container. This allows the liquid to keep flowing from the container during pouring.

In some instances, the vent is provided on the container itself. Such a vent is typically spaced from the dispensing orifice as well as the spout connected to the orifice. The vent on these types of containers typically has its own plug. The plug typically must be manually opened before pouring and then manually closed when done so that liquid doesn't evaporate from the container during storage. The spout also typically must be removed and/or reconfigured when not being used. Also, the dispensing orifice must be capped separately from the vent in order to seal the container for storage. If the container is tipped too much during pouring or if the liquid is poured out too quickly, liquid sometimes can leak from the vent.

On some containers or products of this type, the spout may have a venting feature or vent capability. Some solutions have provided a vent that extends directly through the side of the spout. These types of vents typically leak liquid during the initial pour, at least until air begins to flow back into the container to fill the lost fluid space. Some solutions have provided a vent that extends along the length of the spout. These types of vents typically take a long time to begin allowing air to reenter the container. This is because the air back flow through the vent passage must first overcome a long column of liquid exiting the vent passage or channel before reaching the container interior. Also, these types of pour spouts typically have a separate air channel and liquid channel along a majority of the spout length. However, the separate channels typically share a single mouth or air and liquid passage at the dispensing end of the spout. This can reduce the flow rate of liquid discharged from the spout and can create a significant "glug" effect where air back flow periodically interrupts the liquid flow exiting the dispensing end of the spout.

Other solutions are found on anti-spill pour spouts and other more elaborate systems. Some employ a mechanical shut-off system or valve, which can be costly to manufacture, are likely to be expensive to purchase, and can fail or malfunction during use. Other solutions use a vent that must have a pressure or vacuum differential to open the vent, such as a "duck bill" style valve. A delay typically occurs before the valve opens. Also, the duck bill valve part reduces air flow rate through the valve. In containers of relatively heavy wall thickness, the walls do not collapse, which would otherwise aid liquid flow until the valve opens. Also, the size of the valve can limit the flow rate of air back into the bottle so that the valve cannot keep up with liquid exiting the container.

SUMMARY

In one example, according to the teachings of the present disclosure, a pour spout includes a spout section having an elongate tubular body defining a liquid flow channel. The body has a fluted or corrugated configuration rendering the body flexible or bendable. A dispensing orifice is disposed at a dispensing end of the pour spout. An attachment end is disposed at an end of the body opposite the dispensing end and has a liquid inlet orifice. A vent section is joined to the attachment end of the body. The vent section includes an air vent that defines an air flow path, which directs air from outside of the pour spout along the air flow path toward a container interior while bypassing the liquid flow channel.

In one example, the air vent can have a flow path in part along an annular wall of the vent section.

In one example, the air vent can have a flow path in part along a wall of a skirt of the spout section.

In one example, the air vent can include a flow path in part within a small gap between a skirt of the spout section and an annular wall of the vent section at the attachment end of the pour spout.

In one example, the air vent can include an enclosed space with a vent opening that communicates with a vent tube and a vent that opens to air outside of the pour spout.

In one example, the air vent can include a vent tube with a one-way valve arranged to allow air to flow from a vent opening through the vent tube to an air outlet but to prevent air or liquid from flowing from the air outlet of the vent tube to the vent opening.

In one example, the air flow path can be a circuitous path.

In one example, the body can be collapsible in a lengthwise direction.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed vented pour spout (hereinafter the "pour spout") embodiments and features are designed to solve or improve upon one or more of the above-noted and/or other problems and disadvantages with prior known venting containers and/or vented pour spouts. In one example, a pour spout is disclosed that has a spout section and a vent section. The spout section defines a liquid flow channel along the pour spout and terminates at a dispensing orifice at a dispensing or distal end of the pour spout. The vent section includes an air vent and defines an air flow path into a container that is separate from the liquid flow channel. The air vent can admit air back into the interior of a container while pouring liquid from the container through the liquid flow channel.

In one example, the air vent defines a circuitous air flow path and prevents liquid leaking from the air vent while initially pouring liquid from the container and until air flows back through the air vent into the container interior. In one example, the air vent is positioned so that air initially flows in an upstream direction through one part of the air vent and along one segment of the flow path, and then downstream through another part of the air vent and along another segment of the flow path. These and other objects, features, and advantages of the disclosed pour spout will become apparent to those having ordinary skill in the art upon reading this disclosure.

Though not shown herein, the disclosed pour spout is configured to attach to a dispending aperture of a container. A conventional or generic liquid container may generally have a bottom, a side wall extending up from a perimeter of the bottom, and a top wall joined to the upper end of the side wall. The container may also have a handle on the top wall for carrying the container and to help with holding the container while emptying the container of its liquid contents. The container may have an interior space defined above the bottom, within the side wall, and below the top wall. The interior space typically holds a volume of liquid. The space can be filled and emptied through an opening, i.e., a dispending aperture in the top wall of the container. The dispensing aperture can be surrounded by a threaded collar as is known in the art for receiving a pour spout, closure cap, or the like.

Figure 1:
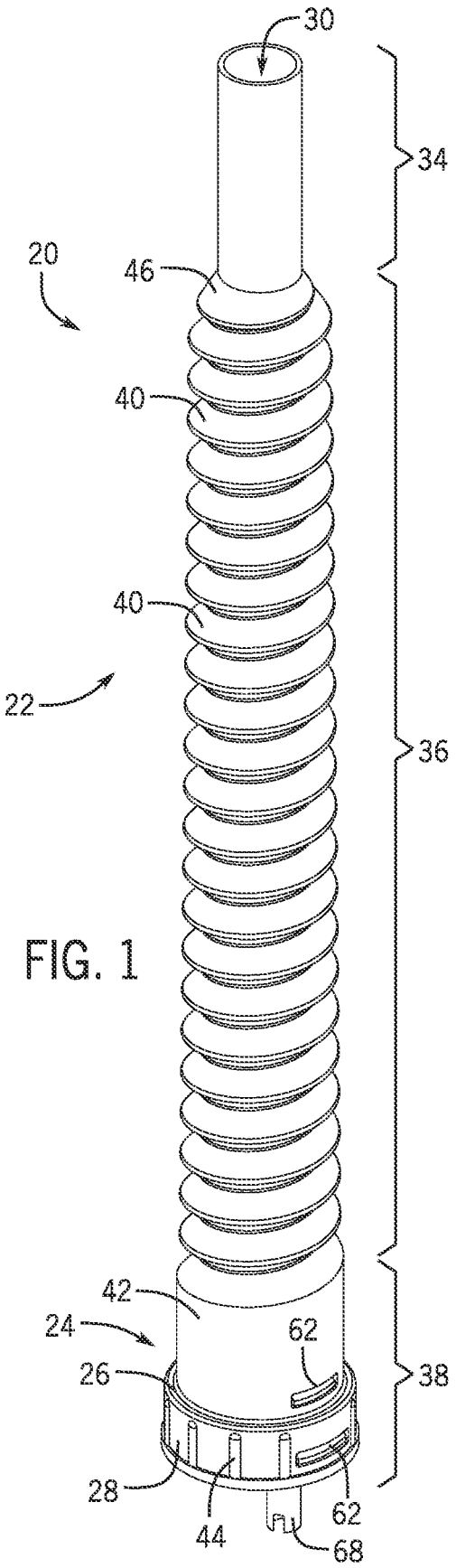
FIG. 1 shows a perspective view of one example of a vented pour spout constructed in accordance with the teachings of the present disclosure.
Figure 2:
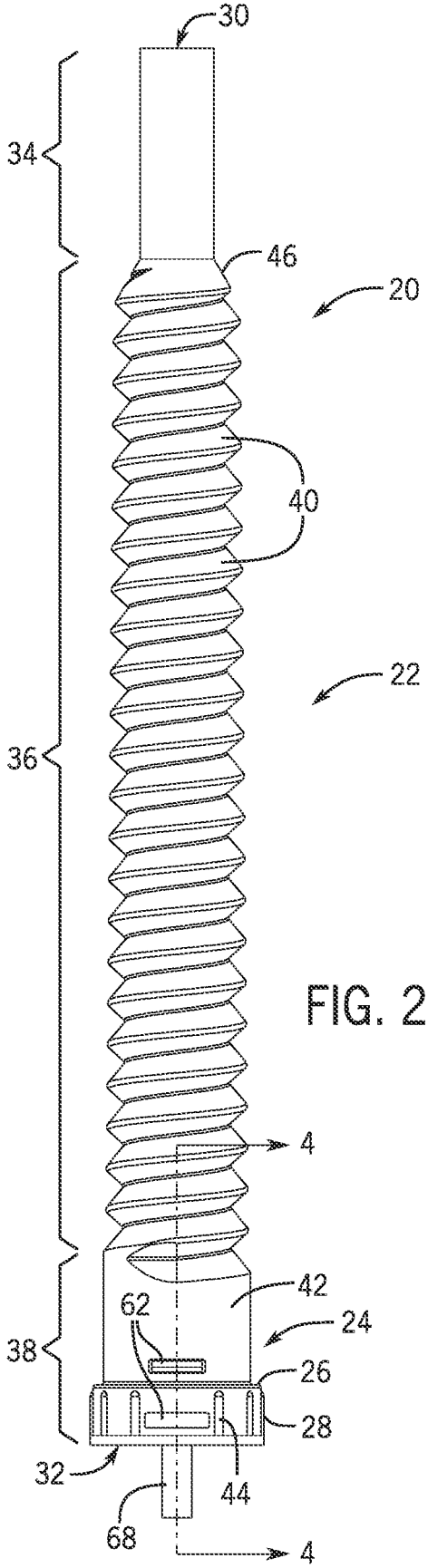
FIG. 2 shows a side view of the vented pour spout and liquid container shown in FIG. 1.

Turning now to the drawings, FIGS. 1 and 2 show one example of a pour spout 20 that is constructed according to the teachings of the present disclosure. The pour spout 20 is attachable to the di spending aperture of the container, as is known in the art. In FIGS. 1 and 2, the pour spout 20 is in an upright orientation, such as when the container is being transported, stored, and/or not being emptied. In this orientation, the bottom wall of the container would rest on a surface and the pour spout 20 would extend upward from the dispensing aperture above the top wall of the container. While dispensing liquid contents from the container and the pour spout 20 would be tipped to a pouring or dispensing orientation, as is known in the art. In this orientation, the container can be at least somewhat tipped, or can even nearly completely inverted so that liquid will be dispensed from the space through the pour spout 20. In order to completely empty the interior space, the bottom wall is typically elevated at least part way above the top wall with the dispending aperture near the lowest elevation of the container. This allows gravity to draw liquid down toward the dispending aperture.

As will be evident to those having ordinary skill in the art, the shape, configuration, and construction of the container can be varied from the example described herein. The container is not intended to limit the scope of the present disclosure or the appended claims. Details of the container can be altered significantly without affecting the disclosed pour spout. The container can be plastic, metal, or another material. The container shape can be rectangular, round, or another suitable shape. The size and storage volume of the interior space of the container can be virtually any desired or suitable volume as well.

Figure 3:
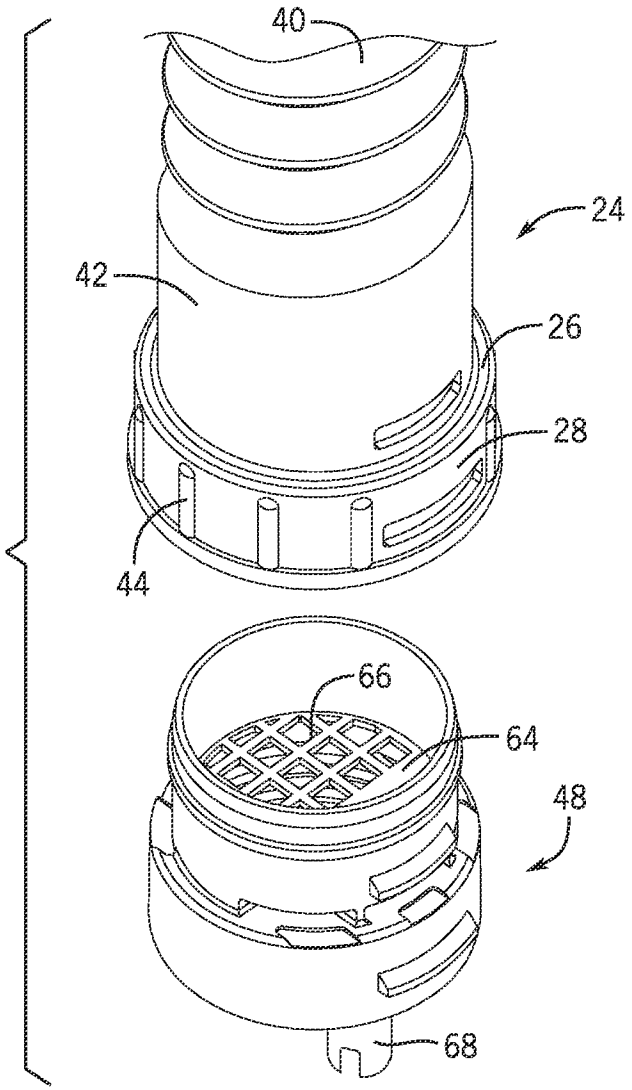
FIG. 3 shows an exploded view of the vented pour spout of FIG. 1, including a spout section and a vent section of the vented pour spout.

FIGS. 1 and 2 show one example of the disclosed pour spout 20 and FIG. 3 shows an exploded view of the pour spout. The pour spout 20 in this example generally has two main parts, including a spout section 22 and a vent section 24 (see FIG. 3). The spout section 22 has a tubular body that defines two ends of the pour spout 20. One end of the pour spout 20 is an attachment end or proximal end that, in this example, is configured to connect or attach to the vent section 24 and then indirectly to the dispending aperture of a container. In this example, the attachment end has a female receptacle with a radial extending flange 26 and an annular skirt 28 extending axially from the perimeter of the flange.

The other end of the spout section 22 defines a dispensing end or distal end of the pour spout 20 that is opposite the attachment end on the tubular body. The dispensing end of the spout section 22 forms an outlet or dispensing orifice 30 that opens into the interior of the tubular body. The tubular body in this example is constructed to form a liquid flow channel lengthwise along the body between the dispensing orifice 30 and a liquid inlet orifice 32 at the attachment end.

In this example, the body has an outer wall with three segments along a length of the wall. The first segment is a dispensing or nozzle segment 34 at the distal end. Along this relatively short nozzle segment 34, the outer wall is round and has a relatively constant shape over its length. The outer wall of the nozzle segment 34 may be tapered so as to have a slightly smaller diameter at the dispensing orifice 30 and a slightly larger diameter at a proximal end.

The proximal end of the nozzle segment 34 joins with a middle segment 36 of the outer wall of the body. The outer wall of the middle segment 36 in this example is corrugated or fluted, i.e., includes a series of corrugations or flutes 40 along a length of the middle segment 36. The flutes 40 or corrugations may be circumferential around the body. The flutes 40 or corrugations can be provided to add flexibility to the tubular body and thus the pour spout 20. The flutes 40 or corrugations may also permit the spout section 22 to be lengthwise collapsible to shorten the spout section to a desired length anywhere between a fully extended length to a fully collapsed length. In this example, the flutes 40 or corrugations are also slightly helical lengthwise along the body, as well as being circumferential around the body. The helical nature of the flutes 40 or corrugations can improve or expand manufacturing options for the pour spout 20, as is discussed further below. In one example, the diameter of the middle section may also be slightly smaller nearer the distal end and slightly larger nearer the attachment end.

The proximal end of the middle segment 36 joins to an attachment segment 38 of the outer wall, which is also relatively short in length in this example. The attachment segment 38 defines the attachment end of the spout section 22 and includes the annular flange 26 and flange 28. On one example, the attachment end can include an outer wall 42 above the annular flange 26 that has no flutes or corrugations, similar to the nozzle segment 34. The attachment segment 38 may include protruding ribs 44 or other protruding elements that can aid one in gripping the pour spout 20 when attaching the pour spout to a container. Such protruding elements may also add strength, stiffness, or rigidity to the attachment end of the pour spout 20.

An optimal combination of fluted or corrugated and non-fluted or corrugated segments can add a desired or predetermined amount of stiffness or rigidity and/or flexibility to the tubular body, and thus to the pour spout 20. In this example, providing the tubular body with a degree of intended flexibility can allow the pour spout 20 to bend during use. This allows the pour spout 20 to be more easily directed into a receiving vessel with less precision and without having to tip the container as much as if the spout were straight and stiff. Likewise, providing the pour spout 20 with a collapsible spout section 22 allows for the spout to be shortened or collapsed in a lengthwise direction for storage or for pouring in tight spaces, as needed.

Further, the cross-sectional shape of the spout section can vary. In this example, the spout section 22 essentially round or circular. The relative size, i.e., length and/or or diameter of the spout section can also vary from the example shown and described herein, as can the length and diameter proportions among the spout section segments. The outer wall construction of the tubular body can thus vary within the spirit and scope of the present disclosure. The disclosure and the appended claims are not limited to the specific examples shown and described herein.

The proximal end or attachment end of the spout section 22 can also include an attachment feature for connecting the vent section 24 to the spout section. The attachment feature can vary and can include mechanical threads or features to be sonically welded to corresponding aspects of the vent section 24. In one example, the attachment feature includes a plurality of open slots 62, which can be provided through the flange 28, the outer wall 42 of the attachment segment 38 above the flange 28, or both, as in this example.

Figure 4:
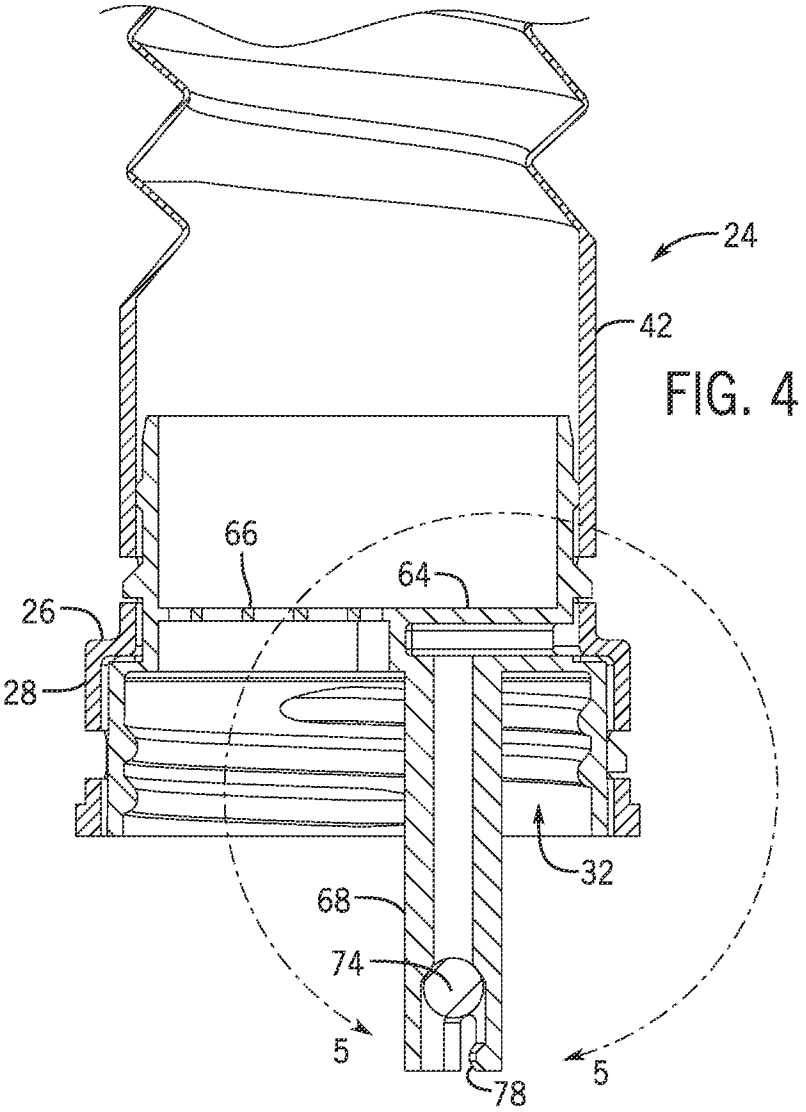
FIG. 4 shows a cross-section taken along line 4-4 of the vented pour spout of FIG. 2.

The spout section 22 can be made from a blow molded, relatively thing walled material so that at least the middle segment 36 of the spout section is flexible and collapsible, if desired. As shown in FIG. 4, the attachment segment 38 outer wall 42 can have a thicker wall thickness to add some additional stiffness and rigidity to that end of the body of the spout section 22. The helical nature of the flutes 40 or corrugations can be utilized to allow the spout section 22 to be "unscrewed" or rotated at least partly out of a blow mold cavity. This can eliminate the need for a mold to have a complex, multiple part, structure, including one or more slides, in order to define the cavity, to form the spout section 22, and then to release the spout section from the mold cavity, once formed.

The distal end of the spout segment of the body, i.e., the nozzle segment 34 defines the dispensing orifice 30 at the terminus of the nozzle segment. The nozzle segment 34 may have a generally round or circular cross-section in this example, though its shape can vary. The outer wall of the nozzle segment 34 may also have a thicker wall thickness than the middle segment 36 of the spout section 22, if desired, to aid in preventing the dispensing orifice 30 from inadvertently closing or partially closing. In this example, the cross-sectional area of the nozzle segment 34 can be at least slightly less than that of the liquid flow channel through the middle segment 36 and the surface on the interior of the nozzle segment 34 can be smooth and cylindrical. The step down 46 in diameter or flow area toward the dispensing orifice 30 allows for a slight fluid pressure build up that creates a strong liquid flow at the dispensing orifice of the pour spout 20 during use. The surface condition and shape can also help to create a smooth dispensed liquid flow from the dispensing orifice 30 of the pour spout 20 during use.

With reference to FIGS. 3 and 4, the vent section 24 is removably attachable to the attachment end of the body of the spout section 22. The vent section 24 has an insert tube 48 configured to fit inside the outer wall 42 of the attachment segment 38, above the flange 28 and radial flange 26. In this example, the insert tube 48 48 has a seal rib 50 that extends circumferentially around the tube and protrudes radially outward. The seal rib 50 bears against the inside surface of the outer wall 42 on the attachment segment 38 to inhibit leakage of liquid as it is being dispensed through the pour spout 20. The inner surface of the outer wall 42 on the attachment segment 38 may optionally have an annular groove (not shown) for receiving the seal rib 50 therein, if desired. In an alternative example, the seal rib 50 may be provided on the attachment segment 38 and, if provided, the annular groove may be provided in the vent section 24.

The vent section 24 also includes a connection portion 52 extending from the proximal or liquid inlet end. The connection portion 52 has an annular wall 54 that seats inside of the flange 28 of the attachment end on the body of the spout section 22. The inner surface of the annular wall 54 includes mechanical female threads 56 that may be configured to engage corresponding male threads on the dispensing aperture on a container. These threads 56 are used to attach the pour spout 20 to a container for use. The attachment end construction can vary and can be configured to accommodate a variety of dispensing aperture configurations found on liquid containers. The annular wall 54 is joined to the insert tube 48 48 by a circumferential shoulder 58 that is configured to closely follow the contour of the radial flange 26 that connects the flange 28 to the body on the attachment end of the spout section 22.

The vent section 24 can also be provided with attachment features 60, or portions of the aforementioned attachment features to secure the vent section to the spout section 22. In this example, tabs, ribs, or protrusions may be provided on the outer surface of the annular wall 54, on the outer surface of the insert tube 48, or both. These features 60 may correspond to the number and position of the open slots 62 formed through the flange 28, the outer wall 42, or both on the attachment end of the spout section 22. The insert tube 48 is slid inside the flange 28 and the outer wall 42 of the attachment end. The tabs 60 snap into the open slots 62 to secure the vent section 24 to the spout section 22. As noted above, the vent section 24 may also include other optional types of features, as long as these features are configured to engage and/or mate with the features on the spout section 22.

The vent section 24 can be formed of a sturdier construction having thicker side wall on the annular wall 54 and insert tube 48 than the spout section 22. In one example, the vent section 24 can be made form a different sturdier material, plastic or otherwise, and using a different process, such as injection molding.

In this example, the pour spout 20 has an air vent, as shown in FIGS. 4-8. The air vent in this example is formed, in part, as an integral portion or component of the vent section 24. The vent section 24 has an obstruction wall 64 disposed perpendicular to the longitudinal axis of the pour spout 20. The obstruction wall 64 in this example is formed integrally as part of the vent section 24. In an alternative example, the obstruction wall 64 may be formed in part on the vent section 24, and in part on the spout section 22, if desired.

In this example, the obstruction wall 64 covers the entire interior diameter of the vent section 24. However, a portion of the obstruction wall 64, in this example about half the surface area of the wall, is formed as a screen 66 or a particle filter screen with multiple holes formed in a mesh-like pattern. The size of the holes can be varied, depending on the types of particles or contaminants the screen 66 is intended to filter out of a liquid dispensed through the pour spout 20. In another example, the obstruction wall 64 may only cover a fraction of the area within the vent section 24. In either case, the obstruction wall 64 is intended to allow liquid to flow into the inlet orifice 32 of the attachment segment 38, along the liquid flow channel of the middle segment 36, and out of the outlet or dispensing orifice 30 in the nozzle segment 34.

In this example, the air vent has a vent tube 68 formed integrally with the obstruction wall 64. The vent tube 68 is oriented perpendicular to the obstruction wall 64 and thus parallel with the longitudinal axis of the pour spout 20. The vent tube 68 extends beyond the proximal end of the pour spout 20 and would extend into the dispensing aperture of a container when attached the container. The vent tube 68 has a distal outlet end that is spaced from the obstruction wall 64 and a proximal end connected to the obstruction wall 64. The outlet end has a hole 70 in communication with an air flow path of the air vent. A portion of the air flow path is provided along the vent tube 68, which is hollow. The proximal end of the vent tube 68 and the air flow path opens into an enclosed space 72 defined within or by a part of the obstruction wall 64. The enclosed space 72 opens to the outside of the vent section 24 via a vent opening through the wall of the insert tube 48 of the vent section.

The vent tube portion of the air flow path is provided with a one-way check valve in this example. The check valve includes a ball 74 sized to float within the vent tube 68. A valve seat 76 is provided toward the proximal end of the vent tube 68. A ball stop 78 is spaced from the valve seat 76 and toward the outlet hole 70 in the vent tube 68. The ball 74 is free to float between the valve seat 76 and the ball stop 78. Air can flow upstream past the ball 74 through the flow path or passage along the vent tube 68 when the ball is not seated against the valve seat 76. Air and liquid cannot flow past the ball 74 when seated against the valve seat 76.

When the vent section 24 is attached to the spout section 22, the wall of the insert tube 48 in this example blocks the vent opening in the side of the vent section. However, a small gap 80 between the annular wall 54 and the flange 28 (see FIG. 5) allows air to pass therebetween. Thus, this small gap 80 forms part of the air flow path for the air vent. These parts can be configured so as to create the small gap 80 circumferentially near the position of the vent opening in the vent section 24. Alternatively, the parts can be configured to create the small gap 80 circumferentially around the entirety of the flange 28 and annular wall 54 or a substantial portion thereof.

Figure 5:
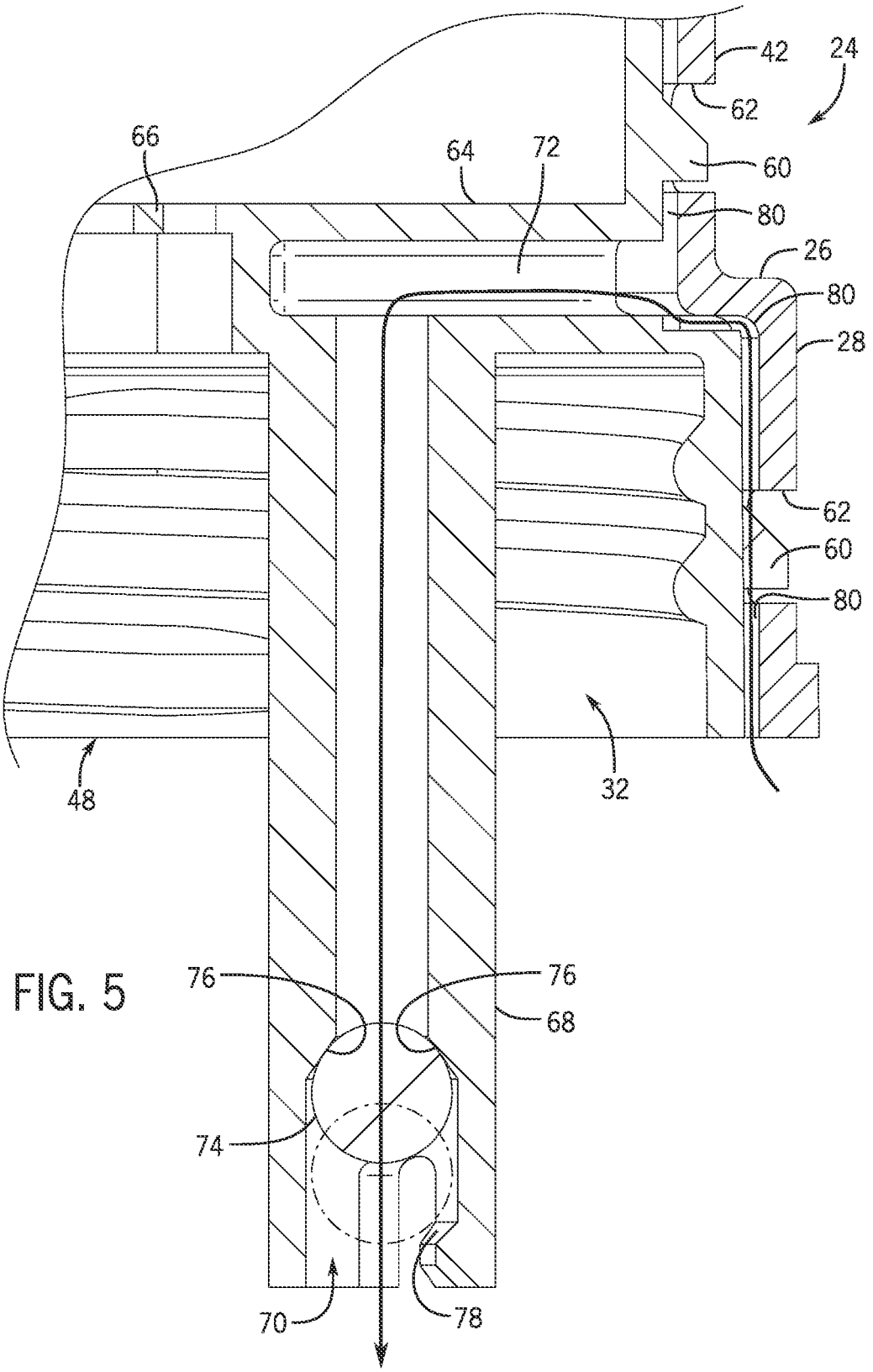
FIG. 5 shows an enlarged portion of the cross-section of the vented pour spout of FIG. 4 and depicts the air flow path for air to enter the pour spout and thus a liquid container to which the spout is attached.
Figure 6:
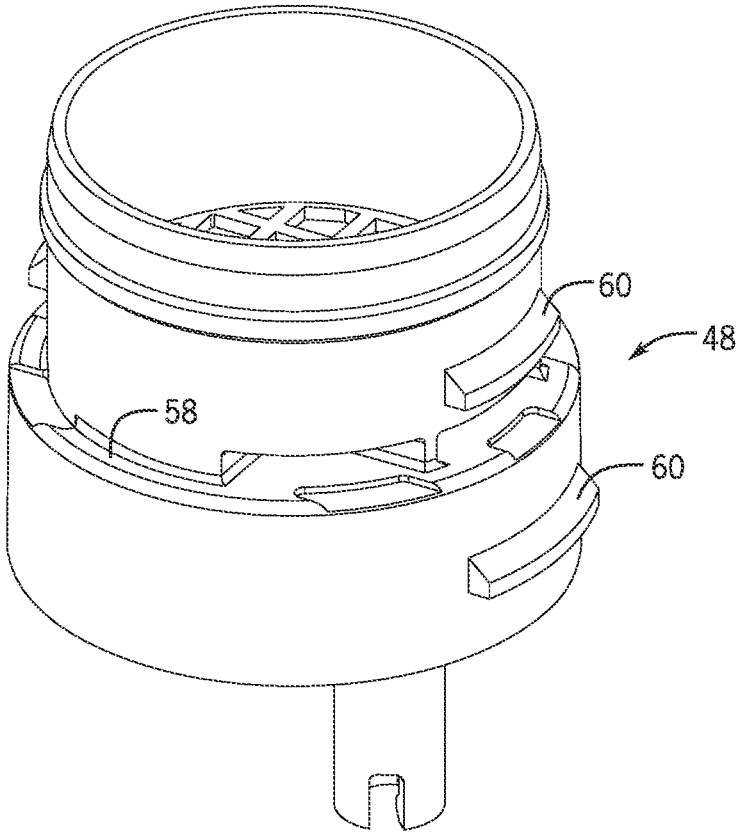
FIG. 6 shows a top perspective view of the vent section of the vented pour spout of FIG. 3.
Figure 7:
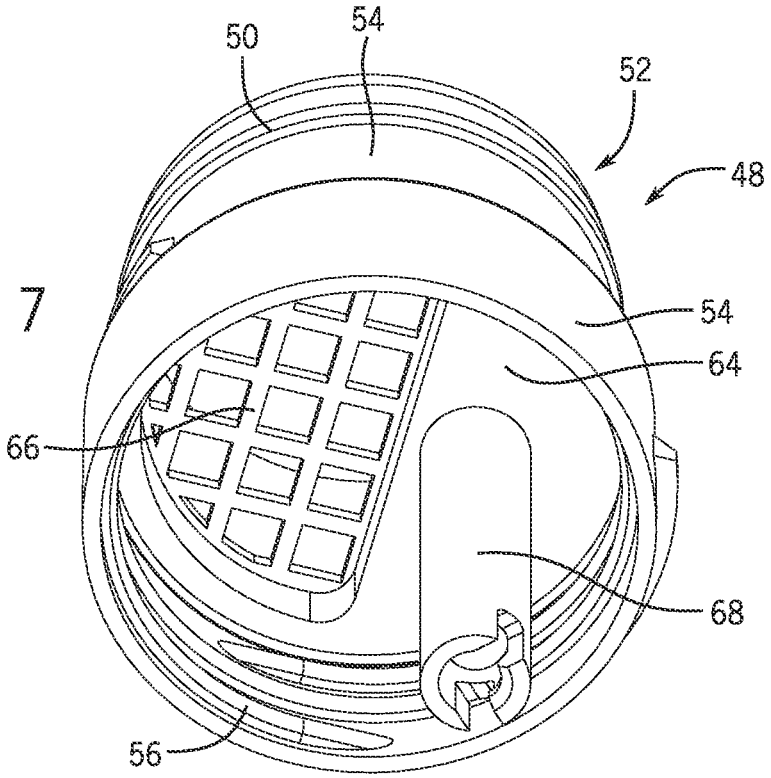
FIG. 7 shows a bottom perspective view of the vent section of FIG. 6.
Figure 8:
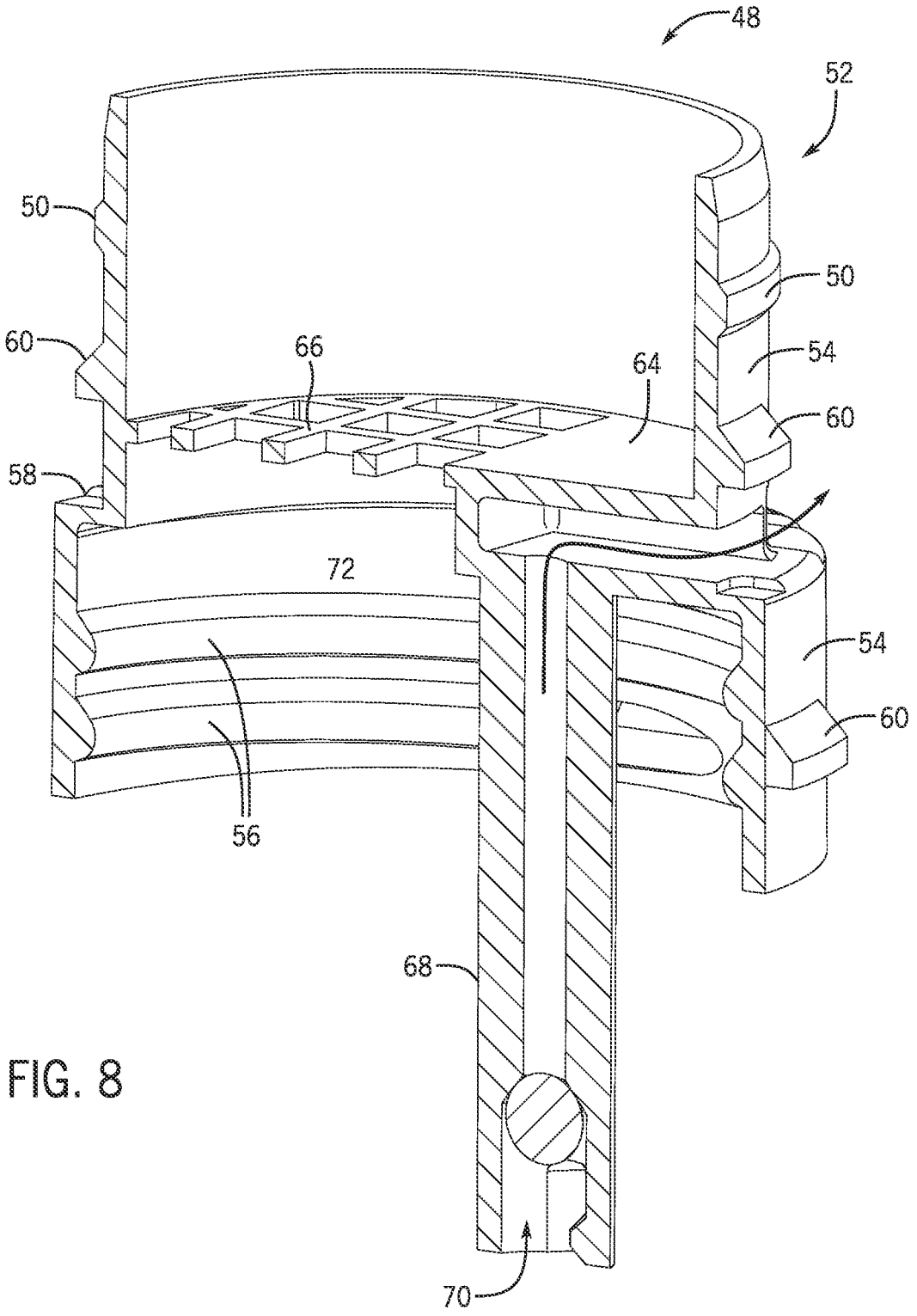
FIG. 8 shows a perspective view of a cross-section, like that of FIG. 4, but of only the vent section.
Figure 10:
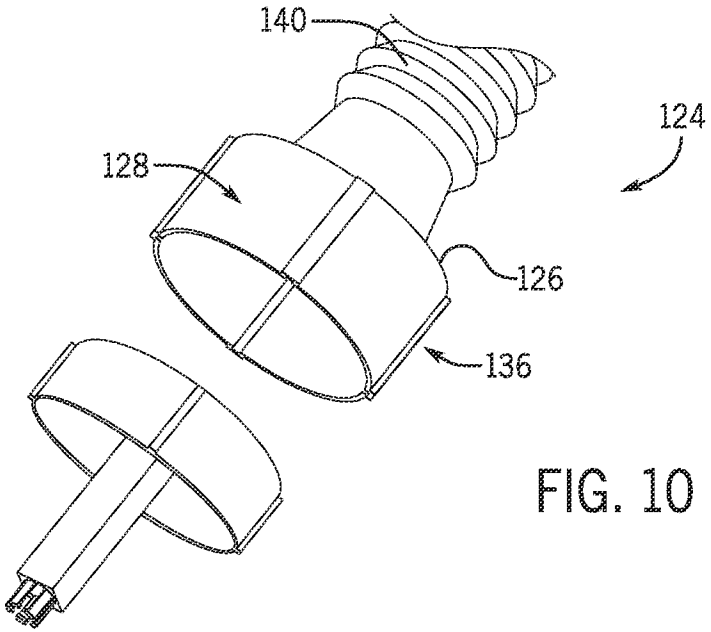
FIG. 10 shows an exploded view of the attachment end portion of the vented pour spout in FIG. 9.
Figure 9:
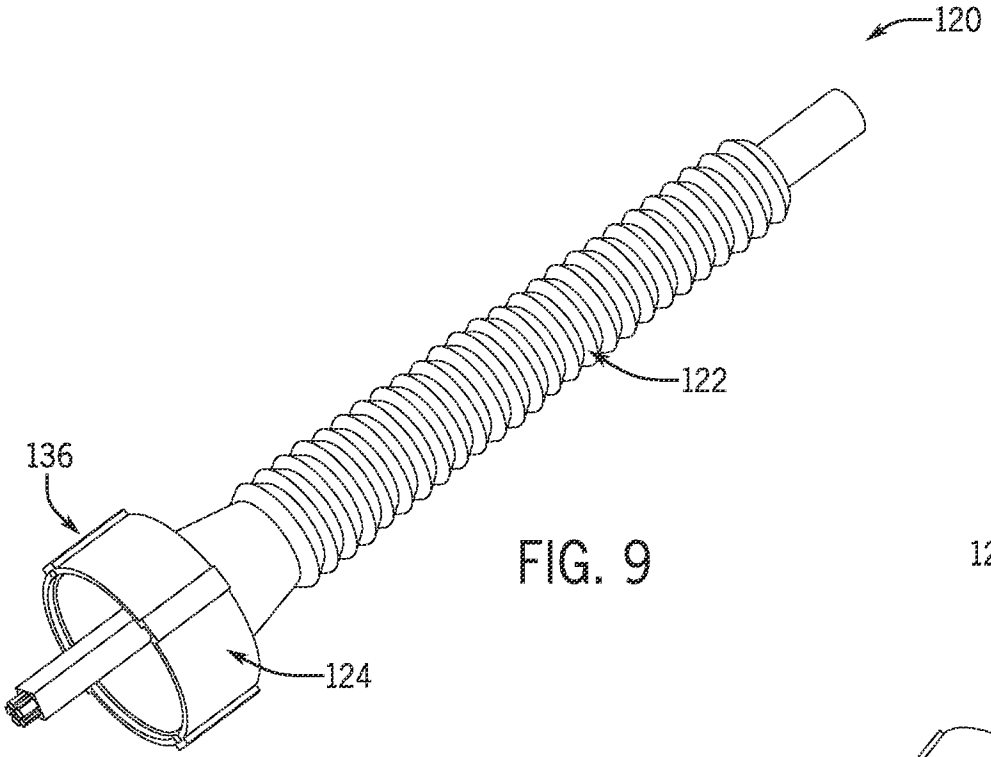
FIG. 9 shows a photograph of a perspective view of another example of a vented pour spout constructed in accordance with the teachings of the present disclosure.
Figure 11:
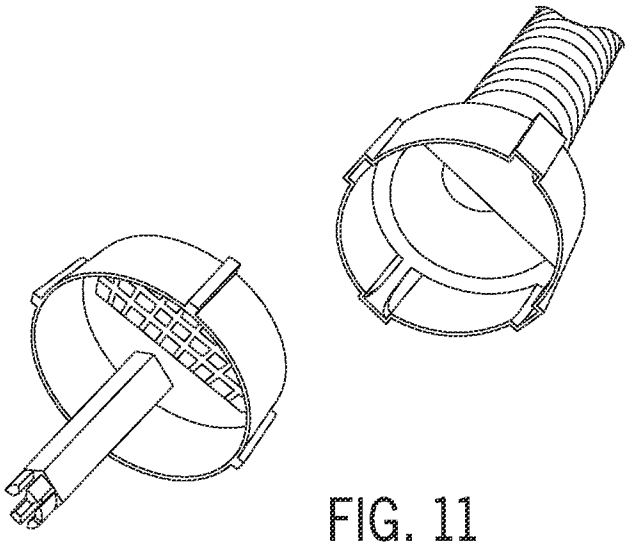
FIG. 11 shows an attachment end perspective view of the vent and spout sections of the vented pout spout of FIG. 10.
Figure 12:
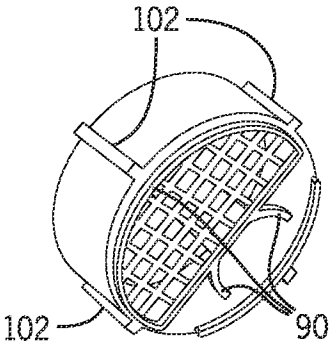
FIG. 12 shows an opposite end perspective view of the vent section of the vented pour spout in FIG. 11.
Figure 12:
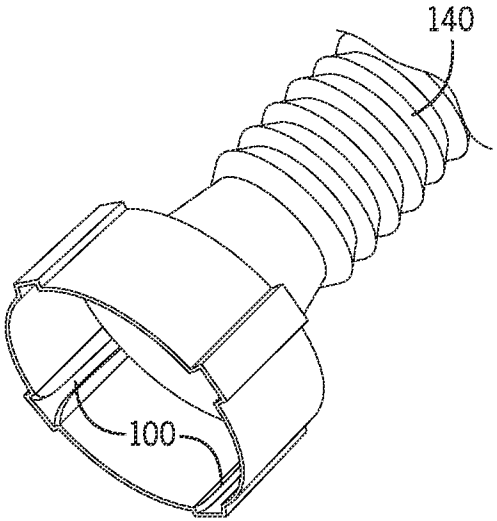

FIGS. 5 and 8 depict how the pour spout 20, and particularly the air vent, functions during use. As the container and pour spout 20 are tipped from the upright orientation of FIGS. 1 and 2 to a dispensing or pouring orientation (not shown), liquid will flow from the interior space of the container through the inlet opening of the attachment end of the pour spout 20. The liquid will flow through liquid flow channel and be dispensed via the dispensing orifice 30 in the nozzle segment 34. As liquid first begins to flow, any liquid that flows into the vent tube 68 will force the ball 74 against the valve seat 76, as in FIG. 5. The check valve will thus prevent liquid from flowing up the vent tube 68 and along the air flow path to the vent opening in the enclosed space 72 and thus prevent leaking of fluid via the air vent between the annular wall 54 of the vent section 24 and the flange 28 of the spout section 22.

After only a very short period of time, such as 5 second or less, or even a fraction of a second, lost fluid from the container will leave a void within the interior space. As is known, air needs to enter the interior space to fill the lost liquid void, or liquid will eventually stop flowing. The air vent in this example provides the path of least resistance for air return. It would require a significant pressure differential, and thus a greater elapsed time, to overcome the head pressure created by the long column of liquid in the liquid flow channel along the pour spout 20 before air would enter the dispensing orifice 30 and return up the pour spout to fill the lost liquid void. Air can instead enter the air vent, which is much closer to the attachment end of the pour spout 20 and thus the interior space of the container. Air entering the air vent will enter the small gap 80 between the flange 28 of the spout section 22 and the annular wall 54 of the vent section 24. The entering air need only overcome a much lower head pressure within the vent tube 68 and against the ball 74 of the check valve, which is the liquid column between the air return outlet and the position of the check valve.

As soon as the pressure differential reaches the head pressure at the check valve, air will flow into the interior space via the air vent. Air first enters the small gap 80 between the flange 28 and the annular wall 54 and flows into the enclosed space 72 via the vent opening. The return air then flows up the vent tube 68 and unseats the ball 74 from the valve seat 76. The return air bypasses the ball 74 and exits the vent tube 68 via the outlet hole 70. Once the air vent provides return air in this manner to the interior space of the container, liquid will completely fill and flow through the liquid flow channel to the pour spout 20. The air vent functions to prevent air return through the dispensing orifice 30, which will prevent the "glug" or air gulping effect. This in turn results in smooth and continuous liquid flow from the pour spout 20. The circuitous air flow path and the check valve of the air vent in this example can prevent liquid from leaking from the air flow path between the flange 28 and the annular wall 54 at the attachment end of the pour spout 20 and until the air vent begins to provide a flow of return air as in FIG. 5.

The function and performance of the air vent, including how quickly the air vent begins to provide return air flow after initial pouring, can be designed and tuned to a particular application and pour spout 20 size and design. For example, the length and/or diameter or cross-sectional area of the vent tube 68, the position and size of the check valve, the mass of the ball 74, as well as the size of the small gap 80, enclosed space 72, and vent opening can be varied to achieve desired air vent performance characteristics.

In order to prevent spilling or evaporation from the container when stored or not in use, a user can plug or stop the dispensing orifice 30 on the disclosed pour spout 20. However, the small gap 80 may also be left open or blocked or plugged as well. A type of plug or cap (not shown) may be provided, if desired, to plug or stop the dispensing orifice 30, as is known in the art.

The foregoing pour spout example is described with some specificity and detail. However, the invention and the scope of the appended claims are not intended to be limited only to the disclosed and described examples. Changes and modifications can be made to the disclosed pour spout without departing from the spirit and scope of the disclosure. Also, specific combinations of aspects, features, parts, and components are provided for the pour spout example disclosed and described herein. However, the disclosure and the scope of the appended claims are not intended to be limited to only these specific combinations. Other combinations of these aspects, features, components, and parts can and are intended to fall within the spirit and scope of the present disclosure. Each aspect, feature, part, and component disclosed and described herein can be utilized alone or can be combined with one or more of the other features, aspects, parts, and components.

The disclosed pour spout 20, or one of the sections, can be fabricated using higher tech materials and molding processes and techniques. However, the disclosed pour spout 20, or one of the sections, also are suitable for lower tech materials and molding processes and techniques. The disclosed vented pour spout sections can be formed of plastic or polymer material and can be blow molded or injection molded. The vented pour spout can alternatively be made from other suitable flexible materials or can be formed of a rigid polymer material, a composite material, a metal material, or combinations thereof. The disclosed pour spout 20 can be fabricated for continued use and durability or can be fabricated for limited or one-time use as a disposable item. The materials used can be recycled plastic material and/or the pour spout 20 can be recyclable as well. The disclosed pour spout 20 can be fabricated in two parts, such as the spout and vent sections, or as a unitary molded or integral piece. The two sections can be fabricated from two different materials or from the same material.

In the disclosed example, creating a circuitous air flow path helps to avoid liquid leaking from the air vent during initial pouring from the container. Both gravity for the ball 74 and the near immediate pressure differential created by fluid flowing to close the check valve prevents liquid from leaking from the air vent.

The vent tube 68 can be a separate component installed or added to the pour spout. The vent tube 68 can also be an integrally molded or an otherwise integrally formed component of the pour spout structure. When a container is near empty, the container pressure begins to equalize with atmosphere. At that point, some liquid may again flow or trickle through the vent tube flow path. The liquid will again close the check valve, although it is possible that a nominal amount of the liquid could leak through the air vent before the ball 74 seats against the valve seat 76. The disclosed pour spout 20 can be oriented on a container in any rotational orientation and will perform as intended.

One advantage of the disclosed vented pour spout 20 is that the dispensing spout is combined with the air vent. This eliminates the need for a separate venting orifice on the container. On a typical container, as noted above, the user must remove both the separate dispenser opening cap and the vent plug before use and then replace both cap and plug after use. Leakage of fluid through the vent is also eliminated in the vented pour spout 20 disclosed herein.

The disclosed vented pour spout 20 provides a reliable, inexpensive, leak-free venting solution for liquid containers, such as fuel cans, gas cans, and the like. The disclosed vented pour spout 20 provides a flexible, optionally collapsible, inexpensive pour spout that also creates an air vent on containers of this type. The disclosed vented pour spout 20 establishes a fluid outlet for dispensing liquid from the container while also establishing an airway from the dispending end of the pour spout back into the container interior. The disclosed pour spout 20 allows for uninterrupted flow of fluid from the container. The disclosed spout prevents the glugging effect created in conventional containers caused by air returning or entering the container through the fluid dispensing channel, which interrupts the flow of liquid.

Injection molding at least the vent section 24, including the threads 56 around the interior of the annular wall 54, may provide a more reliable connection to a container. The type of plastic material may also be selected to provide sufficient rigidity for the same purpose. The length of the pour spout 20 may be such that the parison length might be to long for a narrow mold cavity in order to properly blow mold the spout section 22. An unacceptable amount of scrap may result from failed mold attempts. The helical nature of the above described flutes 40 or corrugations may allow a molder to remove a mold core if the spout section 22 is injection molded or may allow the part to screwed out of the mold cavity if blow molded. The helical structure may also add some strength and rigidity to the molded part, thus allowing a thinner wall thickness. This can reduce the amount of material needed to make the part and thus can reduce part cost.

The slight decrease in diameter of the pour spout 20 toward the distal end can be used to create a draft angle. The draft angle can also aid in separating the molded parts and the mold cavities during manufacture. The screen 66 can be a separate component or can be integrally molded as a part of the pour spout 20. In this example, the screen 66 is part of the vent section 24. Also, the screen hole size should be smaller than the ball diameter so that the ball 74 does not pass through the screen 66 with the liquid, should it escape the vent tube 68. The holes in the screen 66 can vary in size and can be sized to prevent predetermined particle sizes or objects form passing through the screen 66 with the liquid flow. The smaller the hole size, the more the screen 66 will affect liquid flow rate, however.

In one example, the ball 74 of the check valve can have a specific gravity of about 1.0-1.1 or less. A heavier ball 74 may result in allowing a glug effect when the container is emptier because the ball is too heavy to be moved by return air entering the air vent. A lighter ball 74 will work, as liquid will push the ball against the valve seat 76 until the air flow is sufficient to overcome the head pressure of the liquid. The more air that can flow into the container through the air vent, the quicker the container can be emptied. Thus, the various characteristics of the air vent, including the check valve parameters, the vent tube length and diameter, the enclosed air space, and the length and volume of the air flow path portions can be designed to permit a desired air volume to flow during use.

The helical nature of the flutes 40 or corrugations may also provide another benefit during use. With circumferential flutes, the liquid flow channel diameter would essentially be the narrower diameter defined within the channel by the flutes or corrugations. Liquid will not flow into the bellows structure. With the helical structure, the wider diameter of the flutes 40 or corrugations would define the diameter of the liquid flow channel. This is because liquid can flow in the bellows structure and flow in a helical path around and along the pour spout 20. Thus, the helical flutes 40 or corrugations may permit more flow volume for the same sized pour spout.

FIGS. 9-12 show images of a prototype of another example of a vented pour spout 120 constructed in accordance with the teachings of the present disclosure. In this example, the vent section 124 includes a similar structure to the earlier described vent section. The vent tube 68, including the check valve, is still attached to the obstruction wall 64 and extends toward and beyond the attachment end of the pour spout 120. The screen 166 is still also provided on this part of the obstruction wall 164 as well. However, in this example, part of the obstruction wall is provided in the attachment segment 136 of the spout portion. More specifically, the wall portion is part of the radial flange 126 that joins the flange 128 to the body of the spout section 122. The top surface of the obstruction wall 164 on the vent section 124 has raised ribs 90, shown in FIG. 12. The rib surrounding the screen 166 can form a seal around the screen 166 when the two parts are joined. The other ribs are discontinuous and thus can form air flow paths between the two parts of the obstruction wall 164 when assembled. One or more vent openings can be created by the ribs 90 to allow air to enter the space defined by the ribs.

Also, in this example, axial grooves 100 are formed on the flange 128 of the spout section 122 and axial ribs 102 are provided on the annular wall 154 of the vent section 124. These ribs 102 and grooves 100 can create an orientation or alignment feature to make it easy for an assembler to properly orient the screen 166 of the vent section 124 with the liquid flow channel inlet orifice, which in this example is offset from center because of the obstruction wall 164 part formed by the radial flange 126. The air flow path is still defined by the small gap 180 between the annular wall 154 and the flange 128. The enclosed space 172 is instead formed by the two obstruction wall parts when the vent and spout sections are assembled. The axial ribs 102 and grooves 100 can be sonically welded or otherwise adhered or glued to one another when the pour spout 120 is assembled. Likewise, the ribs on the top surface of the obstruction wall 164 on the vent section 124 can be sonically welded or adhered to the obstruction wall part within the spout section 122 and to a circumferential shoulder 158 around the interior of the attachment segment when assembled. To prevent liquid leakage from the liquid flow channel to the enclosed space 172 of the air flow path during use, the rib around the screen 166 should be adequately sealed, attached, or adhered to the obstruction wall part when assembled. The flutes 140 or corrugations in this example are also non-helical but instead are circumferential around the body of the spout section 122.

Although certain vented pour spouts for liquid containers, and aspects, features, parts, and components for such spouts, have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A pour spout comprising:

a spout section having an elongate tubular body defining a liquid flow channel, the body having a fluted or corrugated configuration rendering the body flexible or bendable;

a dispensing orifice at a dispensing end of the pour spout;

an attachment end at an end of the body opposite the dispensing end, the attachment end having a liquid inlet orifice; and a vent section joined to the attachment end of the body, the vent section having an insert tube with one end configured to removably attach to an exterior of a dispending aperture of a container and with another end fit inside an outer wall of the attachment end, wherein the vent section includes an air vent that defines an air flow path, which directs air from outside of the vent section of the pour spout along the air flow path toward an interior of the container through a vent tube, wherein the vent tube is a part of the insert tube and is aligned with the liquid inlet orifice at the attachment end while bypassing the liquid flow channel, and wherein the air flow path is in part along an inner surface of the outer wall of the attachment end and an annular wall of the insert tube of the vent section.

2. A pour spout according to claim 1, wherein the air flow path is in part within a small gap between a skirt of the spout section and the annular wall of the insert tube of the vent section at the attachment end of the pour spout.

3. A pour spout according to claim 1, wherein the air vent includes an enclosed space with a vent opening that communicates with the vent tube and a vent opening to the air outside of the pour spout.

4. A pour spout according to claim 1, wherein the vent tube includes a one-way valve arranged to allow the air to flow from a vent opening through the vent tube to an air outlet but to prevent the air or liquid from flowing from the air outlet of the vent tube to the vent opening.

5. A pour spout according to claim 1, wherein the air flow path is a circuitous path.

6. A pour spout according to claim 1, wherein the body is collapsible in a lengthwise direction.

7. A pour spout comprising:

a spout section having an elongate tubular body defining a liquid flow channel, the body having a fluted or corrugated configuration rendering the body flexible or bendable;

a dispensing orifice at a dispensing end of the pour spout;

an attachment end at an end of the body opposite the dispensing end, the attachment end having a liquid inlet orifice; and a vent section joined to the attachment end of the body, the vent section having an insert tube and being configured to removably attach to a container, wherein the vent section includes an air vent that defines an air flow path, which directs air from outside of the vent section of the pour spout along the air flow path toward an interior of the container through a vent tube, wherein the vent tube is a part of the insert tube and is aligned with the liquid inlet orifice at the attachment end while bypassing the liquid flow channel, and wherein the air flow path is in part within a small gap between a skirt of the spout section and an annular wall of the insert tube of the vent section at the attachment end of the pour spout.

8. A pour spout according to claim 7, wherein the air vent includes an enclosed space with a vent opening that communicates with the vent tube and a vent opening to the air outside of the pour spout.

9. A pour spout according to claim 7, wherein the vent tube includes a one-way valve arranged to allow the air to flow from a vent opening through the vent tube to an air outlet but to prevent the air or liquid from flowing from the air outlet of the vent tube to the vent opening.

10. A pour spout according to claim 7, wherein the air flow path is a circuitous path.

11. A pour spout according to claim 7, wherein the body is collapsible in a lengthwise direction.

* * * * *